United States Patent [19]

Behncke

[11] 4,416,578

[45] Nov. 22, 1983

[54] MULTI-STORY ELEVATOR-TYPE GARAGE

[76] Inventor: Hahns-Jürgen Behncke, Ringseeweg 29, Bad Wiessee, Fed. Rep. of Germany

[21] Appl. No.: 255,437

[22] Filed: Apr. 20, 1981

[51] Int. Cl.[3] ..... E04H 6/06; E04H 6/12

[52] U.S. Cl. ..... 414/249

[58] Field of Search ..... 414/227, 233, 239, 242, 414/243, 244, 249, 261; 187/8.41, 8.59, 24, 25; 52/66; 254/7 R, 7 C, 102, 7 B, 92

[56] References Cited

U.S. PATENT DOCUMENTS

| | | | |
|---|---|---|---|
| 2,655,223 | 10/1953 | Villars | 187/8.59 |
| 2,815,873 | 12/1957 | Moore | 414/249 |
| 3,016,154 | 1/1962 | Ugolini et al. | 414/227 |
| 3,858,371 | 1/1975 | Averill | 52/66 |

FOREIGN PATENT DOCUMENTS

| | | | |
|---|---|---|---|
| 2160828 | 8/1971 | Fed. Rep. of Germany | 414/249 |

*Primary Examiner*—Robert B. Reeves
*Assistant Examiner*—James Barlow
*Attorney, Agent, or Firm*—Robert J. Schaap

[57] ABSTRACT

A roof-covered multi-story elevator-type garage having at least two vertically moveable platforms with one situated above the other by a distance to at least accommodate an automotive vehicle. Each one of the platforms is vertically shiftable to an access level. A garage roof is attached at least in one region to the uppermost of the platforms and is capable of moving vertically with the platform when said uppermost platform is raised to a certain position in its vertical upward movement.

12 Claims, 7 Drawing Figures

MULTI-STORY ELEVATOR-TYPE GARAGE

BACKGROUND OF THE INVENTION

1. Field of the Invention

This invention relates in general to a roof-covered multi-story elevator-type garage with at least two vertically moveable platforms, and more particularly, two multi-story elevator-type garages of the type stated with each of the vertically moveable platforms situated one above the other whereby any one platform may be selected to be moved to a level which is accessible to a drive-in area.

2. Brief Description of the Prior Art

There have been many proposed multi-story elevator-type garages which includes elevators that are designed to move motor vehicles from one level to another and to an entrance and exit. These garages are typically quite expensive in their constructions and are not adpated for low cost installation for use at homes and similar dwelling structures.

Multi-story elevator-type garages offer a possibility to have two vehicles with one above the other parked on platforms and with each platform capable of receiving one or more vehicles. Further, the vehicles may be parked on each of the platforms and which platforms are vertically moveable to an access level. When the platforms are moveable to a fixed access level, the motor vehicles do not have to drive up steep ramps or up and down inclined driveways. Thus, driving in and out is relatively easy and comfortable, particularly in inclement weather, as for example when it is raining or during ice and snow conditions. These constructions further enable entering and exiting of the vehicle with reduced wear and tear on the vehicle, as for example the transmission of the vehicle, since the vehicle is maintained in a generally horizontal position.

In addition to the foregoing, there is no danger that the vehicle may slide, skid or roll downwardly and little or no danger that luggage or other items on the vehicle may become dislodged. Further, due to the fact that the vehicle is not necessarily located or parked in an inclined position, there is little or no danger that gasoline from the gasoline tank will leak. All that is required in the construction of such garages is that the platforms may be lifted or lowered to an access level and lined up with the access or approach level.

It is preferred that garages of this type are provided with two level platforms (two floors) due to the fact that this results in a more favorable relationship between the newly constructed area on one end, and the number of motor vehicles stored or parked on the other hand.

In one prior art construction, a garage design for two motor vehicles was arranged so that one vehicle was located above the other, and thus the overall height of the garage construction would be almost as high as two stories. In one case, where a garage construction would enable one vehicle to be stored above another, the lowest level of the garage and hence the lowest platform could be located below the access level. Thus, in order to drive a vehicle out of the garage, or into the garage and to park the vehicle on a platform of the lowest floor, the platform at ground level would have to be raised to the access level. Also the upper platform would be raised to ceiling level. If the garage had an overall height of one story above ground level, the motor vehicle remaining on the upper platform must first be driven out of the garage. This is due to the fact that the upper platform will then have been raised to the ceiling of the garage construction when the lower platform is at the entrance or approach level.

It is possible to construct the garage one additional story so that when the uppermost platform is in its uppermost position sufficient space is provided to allow for a motor vehicle to be located thereon. This latter construction no longer requires removal of the motor vehicle from the upper platform, when a motor vehicle is to be loaded on or to be removed from the lower platform.

This latter mentioned design of a garage, cannot be constructed, however, if due to certain municipal codes, as for example, building codes, the height of the garage construction is limited. In many areas, there are height requirements or limitations for parking structures. Thus, a garage with two upper levels may not conform to certain building codes.

BRIEF SUMMARY OF THE DISCLOSURE

This invention relates to an elevator-type garage which is constructed in such manner that a plurality, e.g., a pair of vertically moveable platforms are provided and each platform is accessible without having to remove any motor vehicle from any other platform and also, at the same time, to keep the overall height of the construction as low as possible. Other than when exiting or parking vehicles the garage should have a height about one story above the access level. Therefore, the garage roof must be raised over and above the building when a vehicle is driven onto or out of a lower platform (moved up to the access level) in order to make room for the motor vehicle on the upper platform. After loading of the vehicle on the lower platform, this lower platform as well as the roof can be lowered again.

In most garage constructions, the floor-ceiling height is usually more than the standard height of the vehicles parked on the garage floors in order to enable sufficient room for the user of the vehicles to walk. When the upper floor level platform is raised and the roof is also raised in order to provide access to one of the lower platforms, it is only required that the roof be raised above the uppermost platform by a distance approximately equal to the average height of the motor vehicle. In this case, it is not necessary to provide for someone walking on the uppermost platform when in the uppermost position. Thus, in this case it is not necessary to raise the roof above the uppermost platform greater than that of the typical height of a motor vehicle. It is possible to have all of the platforms connected to a moveable carrier and even possibly to the garage roof. The moveable carrier is designed to move the platforms between their upper and lower positions. In the preferred embodiment the moveable carrier would move the lower platform from a position one story below the access level and back. It would also move the upper platform from the access level to one story above the access level. Further, a telescopic arrangement may be employed to cause movement of the garage roof with the uppermost platform.

An especially useful design is employed such that the platforms are connected to the motor vehicle carriage and formed as a component unit. This carriage is provided at corner positions, as for example, four corner portions in a rectangular shaped carriage, with nuts which are engaged by firmly pivoted synchromeshgeared spindle screws. This construction assures a simple and safe drive mechanism and is also especially favorable for use in achieving minimum space requirements.

Another useful feature of the design is also that the spindle screws are connected at the upper ends to a sliding body which is, in turn, engaged to a channel guide connected to the motor vehicle carriage. Preferably, the spindle screws are located in ball-and-socket joints at their lower ends.

To start the rotation of the spindle screws, a common drive motor is used employing a chain drive, whereby preferably the motor engages one of the spindle screws and causes rotation of that spindle screw as well as the others by the connected drive chain.

This invention possesses many other advantages and has other purposes which may be made more clearly apparent from a consideration of forms in which it may be embodied. These forms are shown in the drawings acompanying and forming part of the present specification. They will now be described in detail, for the purposes of illustrating the general principles of the invention; but it is to be understood that such detailed descriptions are not to be taken in a limiting sense.

BRIEF DESCRIPTION OF THE DRAWINGS

Figure 1:
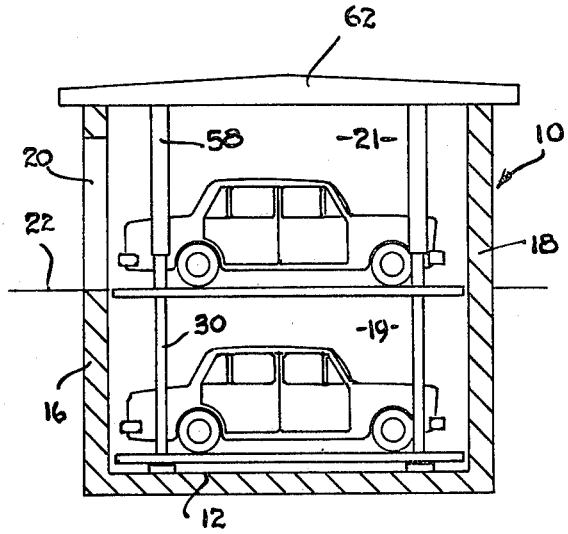
Figure 2:
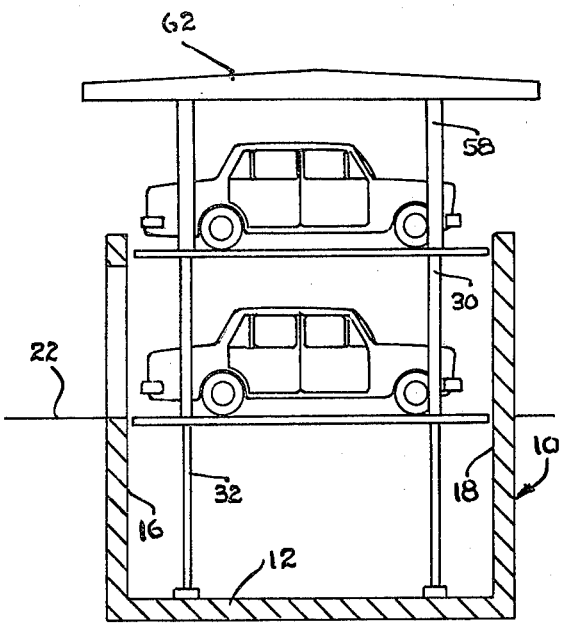
Figure 3:
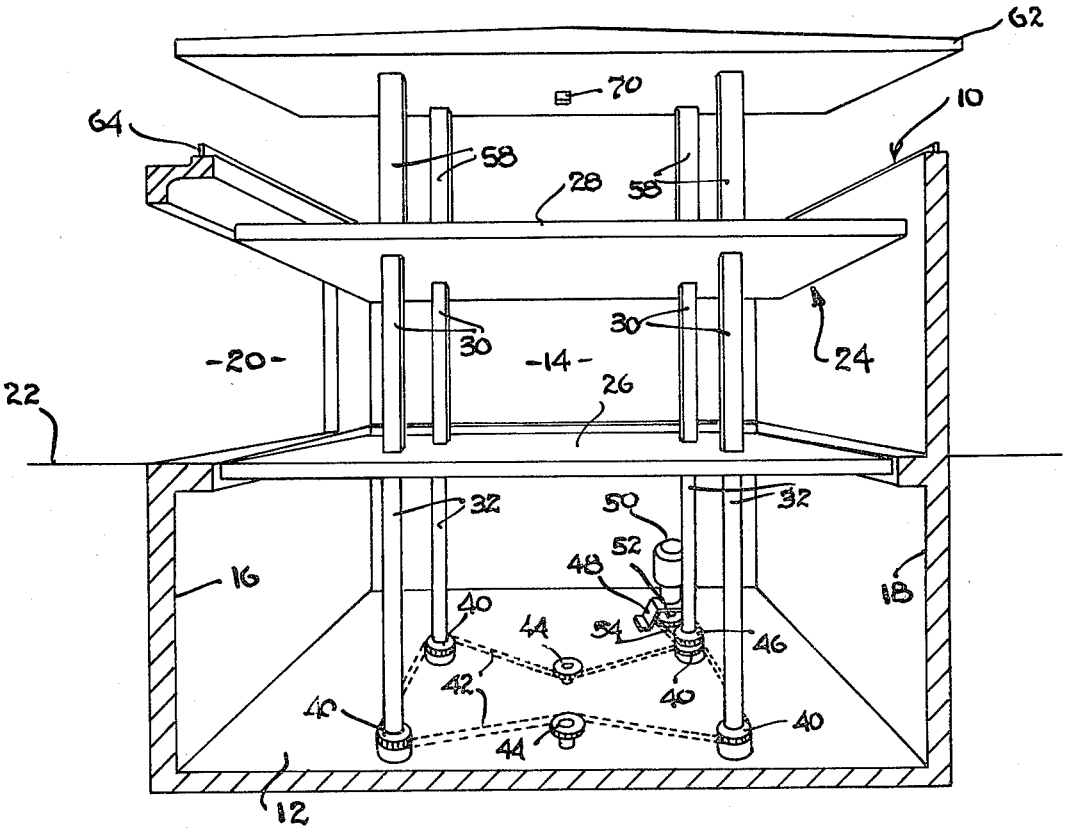
Figure 4:
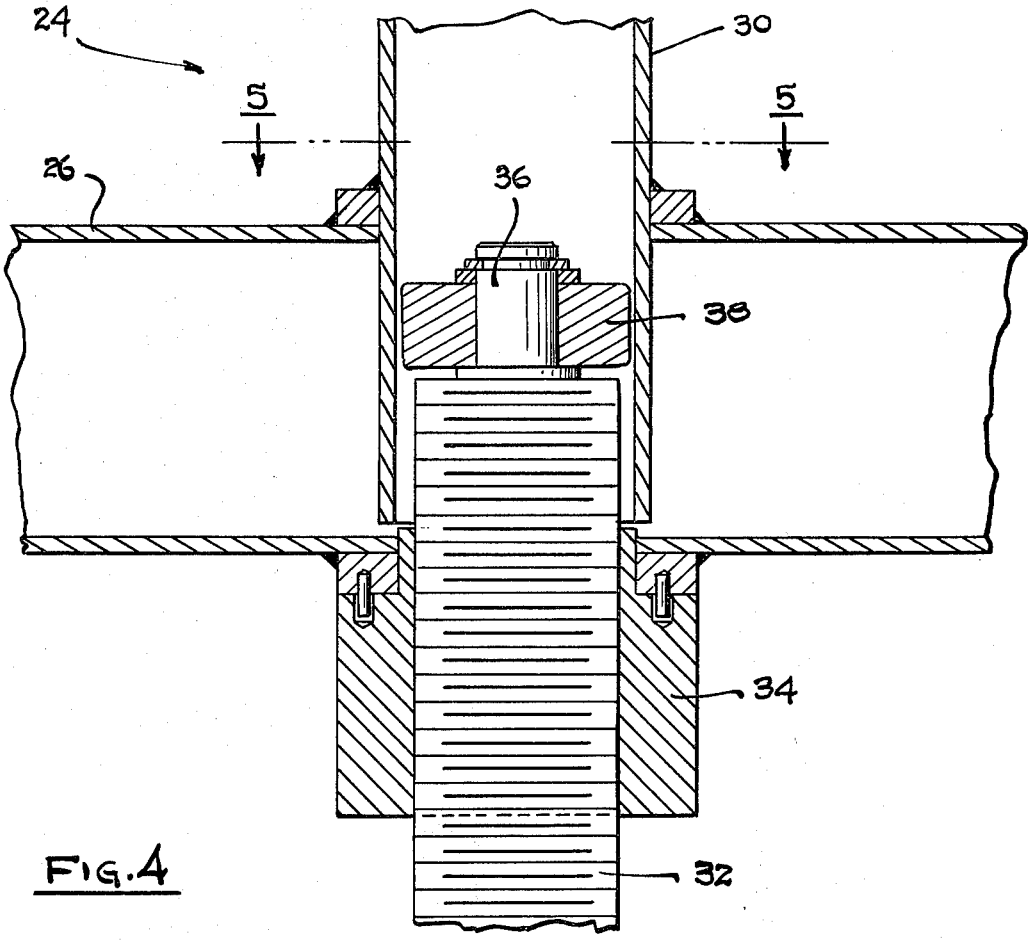
Figure 5:
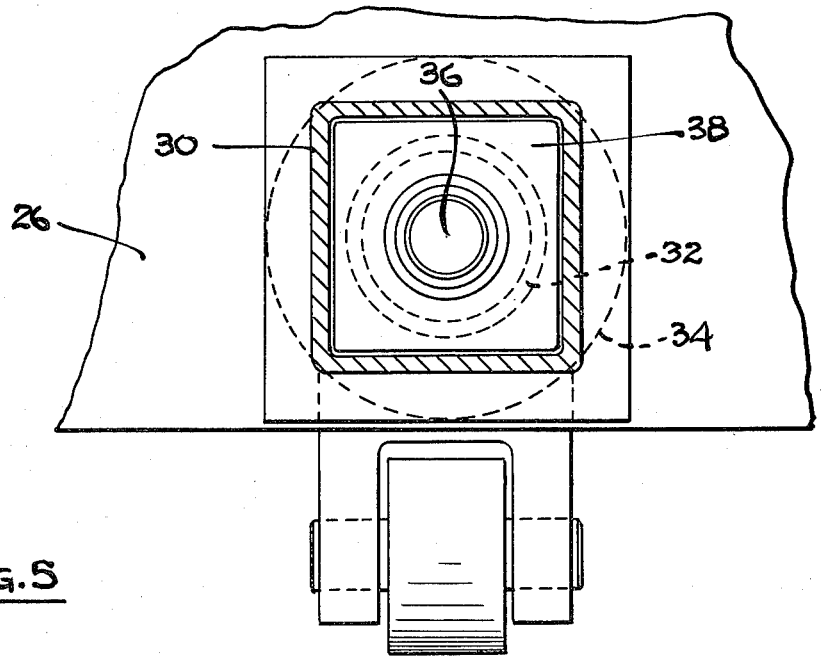
Figure 6:
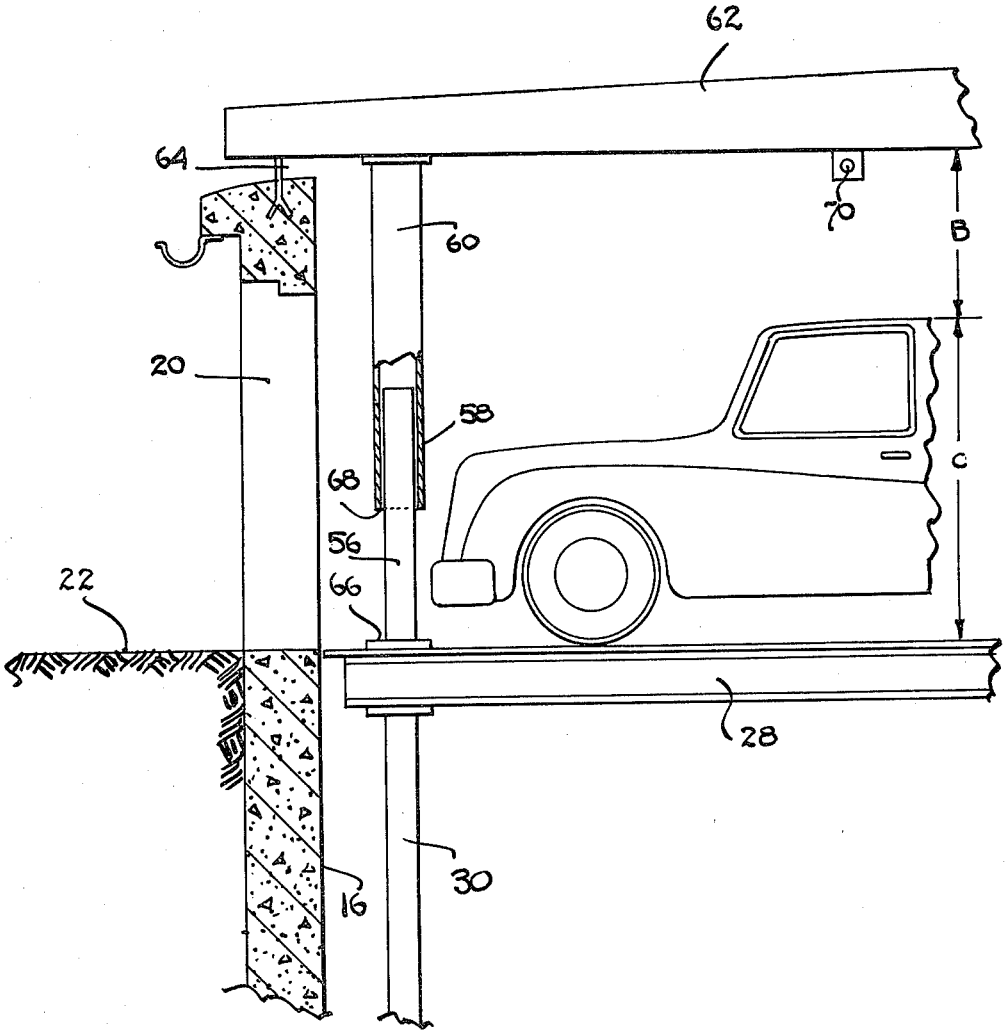
Figure 7:
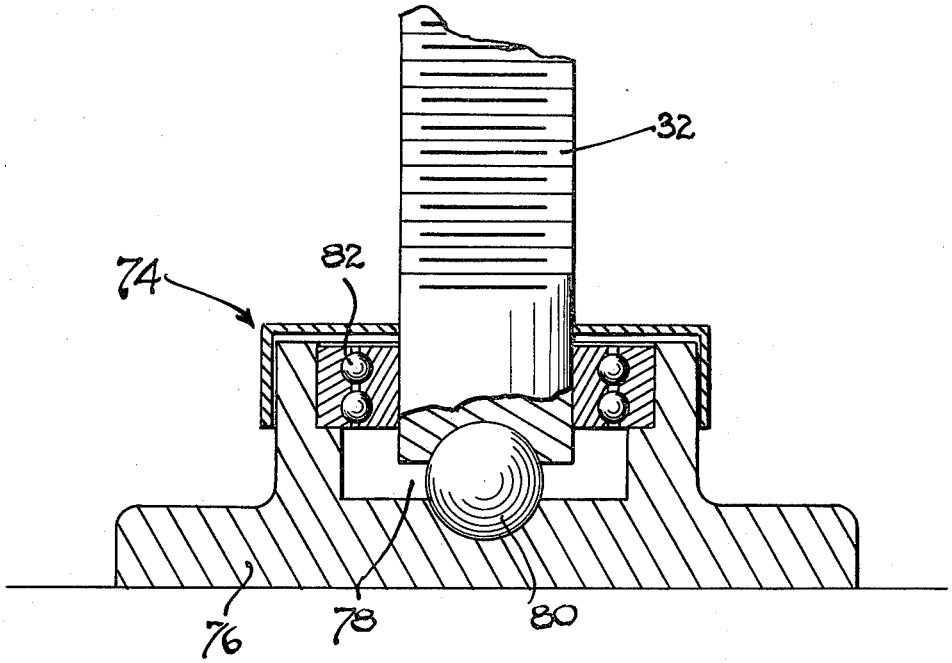

Having thus described the invention in general terms, reference will now be made to the accompanying drawings in which:

FIG. 1 is a schematic vertical sectional view of a multi-story elevator-type garage in its basic position in which both platforms are occupied by a motor vehicle, and which is constructed in accordance with and embodies the present invention;

FIG. 2 is a schematic vertical sectional view of the multi-story elevator-type garage of FIG. 1 with the elevator platforms shifted to their uppermost position whereby entry and exiting of a vehicle from the lower floor level is enabled;

FIG. 3 is a perspective view of a multi-story elevator-type garage in a position equivalent to that as shown in FIG. 2;

FIG. 4 is a sectional view of a guide channel for one of the spindle screws forming part of a motor vehicle carriage and which forms part of the garage structure;

FIG. 5 is a horizontal sectional view taken along line 5—5 of FIG. 4;

FIG. 6 is a vertical sectional view showing a linkage between a motor vehicle carriage and the garage roof; and FIG. 7 is a vertical sectional view showing a ball and socket joint mounting the lower end of a spindle screw forming part of the present invention.

DETAILED DESCRIPTION OF A PREFERRED EMBODIMENT

Referring now in more detail and by reference characters to the drawings which illustrate a practical embodiment of the present invention, the elevator-type garage is fully illustrated in FIGS. 1 to 3 of the drawings.

This garage is generally comprised of a structural body 10 having a floor 12 along with spaced apart side walls 14 and with one side wall situated opposite to the other. The garage also includes a front wall 16 and a back wall 18. The garage shell comprised of the vertically disposed walls and the floor 12 may be disposed within an excavation in the ground. Further, the garage shell would be formed so that an entrance or access opening 20 is located at the ground level 22, as illustrated in FIGS. 1 and 2 of the drawings.

The access opening 20 is preferably included in the front wall 16 and this wall 16 may be provided with a gate or door over the opening 20. This gate or door may be locked by appropriate conventional means neither illustrated nor described in any detail herein. It should be understood that the garage structure 10 may be formed as a pre-manufactured unit and merely inserted into an excavation in the ground as illustrated. Mounting of the shell is such that the lower portion of the access opening 20 is on the same level as the ground level 22.

The interior of the structural body 10 is provided with a motor vehicle carriage generally identified by reference numeral 24 and which is guided in its vertical movement, at each of the side walls 12 by means of guides (not shown). The motor vehicle carriage 24 is provided with two generally horizontally disposed vertically spaced apart platforms situated parallel to one another and include a lower platform 26 and an upper platform 28. Further, the motor vehicle carriage is located so that it is moveable between a lower position as shown in FIG. 1 where the lower platform is located against or is slightly spaced above and incidental to the floor 12 and also to an upper position as shown in FIG. 2. When the motor vehicle carriage 24 is in the lower position, the upper platform 28 is aligned with the access opening 20 and the ground floor level 22. When in the upper position, the lower platform 26 is aligned with the access opening 20 and the ground level 22.

The lower platform 26 and the upper platform 28 are connected with each other adjacent their four corners by vertical supports 30, the latter of which are of hollow construction and they also serve as the guide channels as hereinafter described in more detail. Extending upwardly from the base floor 12, are vertical spindle screws 32 with each screw 32 being journaled in bearings, preferably in ball-and-socket joints. This journaling is shown in detail in FIG. 7 and described in more detail hereinafter, although the ball and socket joint is conventional in construction. This construction is also desirable in that it enables easy adjustment of the spindle screws when needed and also avoids jamming of the drive operation.

The supports 30 are provided at their lower ends, that is, at the height level of the lower platform 26 when the platforms are raised to the position as illustrated in FIGS. 2 and 3, with nuts 34, as best illustrated in FIG. 4. These nuts 34 are engaged by the spindle screws 32 which are generally aligned with the supports 30. The spindle screws 32 extend vertically and are engaged by the nuts 34 in such manner that when the motor vehicle carriage is in its lower position, the screws 32 will project outwardly thereof. The spindle screws 32, at their upper ends, are provided with studs 36 to receive a generally square-shaped glider 38. This glider 38 is adapted to guide the spindle screws 32 within the interior of the supports 30 using the latter as a guide channel and in this way, also serve to guide the platforms 26 and 28 in their vertically shiftable movement.

The lower ends of the spindle screws are provided with sprockets 40 and a driving chain 42 is trained around each of the sprockets 40 of the spindle screws 32. In addition, the chain 42 is trained around a drive chain tensioner 44 which may be in the form of a spring mounted device. Connected to one of the spindle screws 32 immediately above the sprockets 40 is a second sprocket 46 and adjacent to the sprocket 46 on the ground floor 12 is bracket 48 which supports a drive motor 50. By reference to FIG. 3, it can be observed that the output drive shaft of the drive motor 50 is provided with a drive sprocket 52. Another driving chain 54 is turned around the sprockets 46 and 52, also in the manner as illustrated in FIG. 3 of the drawings.

When the motor 50 is energized, the drive chains 54 and 52 will cause rotation of the spindle screws 32 in the same direction. The drive motor 50 is adapted to operate in both forward and reverse directions. When rotated in one direction, they will cause upward movement over platforms and when rotated in the opposite direction, the drive spindles 32 will cause lowering movement of the two platforms. Both of the final positions, that is the uppermost and lowermost position of the motor vehicle carriage 24 is controlled by an appropriate conventional limit switch arrangement which is neither illustrated nor described herein.

In the lowermost position of motor vehicle carriage 24, the spindle screws 32 project well into the interior of the supports 30. In this way, the glider 38 in the guide channels support the spindle screws 32.

The supports 30 are provided with extensions 56 which extend upwardly above the upper surface of the uppermost platform 28, which function as guide elements, in the manner as more fully illustrated in FIG. 6 of the drawings. These vertical guide elements 56 are connected to form part of a telescopic guidance, generally identified by reference numeral 58. This telescopic guidance comprises the vertical guide elements 56 and guide elements 60 which extend downwardly from and which are rigidly secured to the lower surface of a carriage roof 62.

The uppermost edges or margins of the side walls 14, the front wall 16 and the rear wall 18 are provided with support strips or support ledges 64 in the form of flat irons or so-called "billets". When the motor vehicle carriage 24 is in the lowermost position, as is illustrated in FIG. 1, the garage roof 62 may rest on the support ledges 64. The garage roof 62 therefore merely rest lengthwise or on relatively narrow strips, namely the support ledges 64. Not only do the support ledges 64 serve as a seat, they also serve as a seal so that during inclement weather, rain, ice or snow, is prevented from entereing into the interior of the garage.

The support ledges 64, could be substituted by suitable insulation which may be provided in the garage 62. Further, suitable insulation may be provided in addition to the support ledges. This is particularly desirable in the event that the garage structure itself is to be heated or temperature controlled.

It is desirable to ensure that the garage roof 62 rests securely on the ledges 64 which serve as a seat when the motor vehicle carriage 24 reaches its lowermost position. Otherwise, unavoidable manufacturing inaccuracies as well as damage might otherwise result. Further, the garage roof 62 is vertically shiftable relative to the motor vehicle carriage 24 and is achieved by the telescopic guidance 58 previously described and is hereafter described in more detail.

The vertical movement of the roof 62 is described in more detail hereafter. The vertically moveable vehicle carriage 24 is connected with respect to the roof 62 in such manner that the garage roof 62 shall not participate in the total elevating movement of the motor vehicle carriage 24. The garage roof 62 shall be limited to that necessary to enable clearance for a vehicle on the upper platform 28. In other words, the total elevating movement of the garage roof 62 shall be less than that of the motor vehicle carriage 24.

By further reference to FIG. 2, it can be observed that as the motor vehicle carriage is shifted from its lowermost position (FIG. 1) to the uppermost position, as illustrated in FIG. 2, the garage roof 62 will raise from the support ledges 64. Further, the roof 62 is raised by a distance above the support ledges 64 to an extent that the motor vehicle remaining on the upper garage roof 62. By reference to FIGS. 1 and 2, it can be observed that the overall vertical dimension between the two platforms 26 and 28 is sufficient to receive a vehicle and also provide sufficient walking room. Also in the lower position the dimension between the platforms 26 and 28 is approximately equal to the dimension between the roof and platform 28. When the motor vehicle carriage 24 is shifted to the lowermost position, the overall distance between the surface of the platform 28 and the under surface of the roof 62 will be approximately equal to a distance of C plus B, as illustrated in FIG. 6. However, when the motor vehicle carriage 24 shifted to the uppermost position, the roof 62 may be raised above the platform 28 by the distance C. In other words, it is not necessary to raise the roof beyond the distance C or for an amount slightly greater than the distance C. In other words, it is not necessary to shift the roof upwardly for the distance B. This is due to the fact that when in the upper position, typically no one will be walking on platform 28.

Each of the guide elements 56 are mounted on or extended upwardly of the upper surface of the platform 28, in the manner as illustrated in FIG. 6. The guide elements 60 have lower ends 68 which operate in combination with the discs 66 on the platform 28 to function as a mechanical stop. In this way, the distance between the upper surface of the upper platform 28 and the roof 62, namely the distance C can be achieved when the lower ends 68 engage the discs 66. This will result when the carriage 24 is shifted to the uppermost position. Thus, the clear distance B between the upper roof of the vehicle and the lower surface of the roof 62 will not be obtained.

If it is preferred, a sensor 70 may be installed on the lower surface of the garage roof 62 and which can be activated by a motor vehicle remaining on the upper platform 28 to thereby cause the drive motor to stop rotation. By this action, any motor vehicle damage will be prevented in case a vehicle is located on the upper platform 28.

By appropriate dimensions of the guide elements 60 and/or the guide elements 66 or in the techniques of installing these elements 60 and 66 the overall height of the garage roof 62 may be changed or adjusted as may be required. The lower ends of the spindle screws 32 are mounted in ball and socket joints 74 which are of a conventional construction. Each ball and socket joint 74 comprises a bearing box 76 having a socket portion 78 to hold a ball 80 and which supports the lower ends of a spindle screw 32, as shown. Conventional ball bearings 82 may support the lower ends of the spindle screw 32, also as shown.

Thus, there has been illustrated and described a unique and novel multi-story elevator-type garage which permits a garage roof to be moveable with one of the platforms of the garage, and which therefore fulfills all of the objects and advantages sought therefor. It should be understood that many changes, modifications, variations and other uses and application of the method of making such garage structures will become apparent to those skilled in the art after considering this specification and the accompanying drawings. Therefore, any and all such changes, modifications, variations and other uses and applications which do not depart from the nature and spirit of the invention are deemed to be covered by the invention which is limited only by the following claims.

Having thus described my invention, what I desire to claim and secure by letters patent is:

1. A multi-story elevator-type garage for the temporary storage of moveable vehicles and being operable with respect to an access level where vehicles may be moved into and exit said garage, said elevator-type garage comprising a vertically moveable carrier, at least two vertically spaced apart vertically moveable platforms with one situated above the other, each of said platforms being operatively connected to said carrier for upward and downward movement with said carrier so that each may be individually shiftable to said access level, a plurality of vertically disposed columns extending between said platforms and said columns extending above the uppermost of said platforms, a garage roof disposed above the uppermost of said platforms, supports on the underside of said garage roof and being telescopically connected to said columns so that said garage roof is operatively connected to at least one of said platforms and being moveable with the uppermost of the platforms, said garage roof being disposed above the uppermost platform by a distance substantially equal to the vertical distance between each of the other platforms when the carriage and platforms are in their lowermost positions, and said garage roof being telescopically lowered relative to said uppermost of the platforms so that the distance between the uppermost of the platforms and the platform therebeneath is substantially less than the distance between the other platforms when said carriage and said platforms have been raised to their uppermost position.

2. The multi-story elevator-type garage according to claim 1 further characterized in that said supports limit the downward movement of said garage roof, said supports also being designed so that when the platforms are in their uppermost position, the roof is at a distance above the upper platform sufficient to accommodate a motor vehicle.

3. A multi-story elevator-type garage according to claim 2, further characterized in that said support is connected to such garage roof in such manner that when the upper platform is in its uppermost position, the distance between the garage roof and the uppermost platform is less than the distance between said platform and that platform located immediately therebeneath.

4. A multi-story elevator-type garage according to claim 3, further characterized in that said support comprises a telescopic member which enables a telescopic arrangement between said garage roof and the uppermost of said platforms.

5. The multi-story elevator-type garage according to claim 2, further characterized in that said supports are adapted to contact a fixed element located on the upper surface of said upper platform and that the supports are connected to the undersurface of said garage roof.

6. The multi-story elevator-type garage according to claim 2 further characterized in that a drive unit is provided for shifting said carrier and the platforms therewith, said drive unit being comprised of nuts located and associated with at least one of said platforms, and synchromesh spindle screws operative with said nuts and being rotated with respect to said nuts for causing said platforms to move upwardly and downwardly through rotary motion of said spindle screws.

7. A multi-story elevator-type garage comprising at least two vertically spaced apart vertically moveable platforms with one situated above the other, each of said platforms being shiftable to an access level, a moveable carrier operatively connected to said platforms for causing upward and downward movement of said platforms, a garage roof operatively connected to at least one of said platforms and being moveable with the uppermost of the platforms when the uppermost of the said platforms has been raised to a certain position, a support operatively connected to said garage roof for limiting the downward movement thereof and to enable the roof to be spaced above the upper platform by a distance sufficient to accommodate a motor vehicle when the platforms are in their uppermost position, so that the distance between the garage roof and the uppermost platform is less than the distance between said uppermost platform and a platform located immediately therebeneath when all platforms are in their uppermost position, a column forming part of said carrier, a sliding member disposed within and engaging said column, synchromesh spindle screws connected at their upper ends to said sliding member, and a drive unit operatively connected to said carrier for shifting said carrier and the platforms therewith, said drive unit being comprised of nuts located and associated with at least one of said platforms, said synchromesh spindle screws being operative with said nuts and being rotated with respect to said nuts for causing said platforms to move upwardly and downwardly through rotary motion of said spindle screws.

8. The multi-story elevator-type garage according to claim 7, further characterized in that said spindle screws are connected at their lower ends in ball-and-socket joints.

9. The multi-story elevator type garage according to claim 8, further characterized in that a drive motor forms part of said drive unit and is operatively connected to said spindle screws through a drive chain for causing rotation of said spindle screws.

10. A multi-story elevator-type garage comprising at least two vertically spaced apart vertically moveable platforms with one situated above the other, each of said platforms being shiftable to an access level, a moveable carrier operatively connected to said platforms for causing upward and downward movement of said platforms, a garage roof operatively associated with said platforms and being disposed over the uppermost of the platforms by a distance at least sufficient to accommodate a motor vehicle when the platforms are in their uppermost position, a support operatively connected to said garage roof, a column forming part of said carrier and being engageable with said support, a sliding member disposed within and engaging said column, synchromesh spindle screws connected at their upper ends to said sliding member, ball-and-socket joints which receive said spindle screws at their lower ends, a drive unit operatively connected to said carrier for shifting said carrier and the platforms therewith, said drive unit being comprised of nuts located and associated with at least one of said platforms, said synchromesh spindle screws being operative with said nuts and being rotated with respect to said nuts for causing said platforms to move upwardly and downwardly through rotary motion of said spindle screws, a drive motor associated with said drive unit, and a drive element operatively connected to said spindle screws and drive motor for causing rotation of said spindle screws.

11. The multi-story elevator-type garage of claim 10 further characterized in that the distance between the garage roof and the uppermost platform is less than the distance between said uppermost platform and a platform located immediately therebeneath when all platforms are in their uppermost position.

12. The multi-story elevator-type garage of claim 10 further characterized said drive element in a drive chain.

* * * * *